US007388334B2

(12) United States Patent
Crandall et al.

(10) Patent No.: US 7,388,334 B2
(45) Date of Patent: Jun. 17, 2008

(54) HIGH FREQUENCY ELECTRONIC BALLAST WITH SINE WAVE OSCILLATOR

(75) Inventors: Earl F. Crandall, Raleigh, NC (US); Robert C. Smallwood, Sr., Englewood, CO (US); Robert G. Crandall, Manchester, NH (US)

(73) Assignee: PureSpectrum, Inc., Savannah, GA (US)

( * ) Notice: Subject to any disclaimer, the term of this patent is extended or adjusted under 35 U.S.C. 154(b) by 0 days.

(21) Appl. No.: 10/817,768

(22) Filed: Apr. 2, 2004

(65) Prior Publication Data

US 2005/0104539 A1 May 19, 2005

Related U.S. Application Data

(60) Provisional application No. 60/460,381, filed on Apr. 4, 2003, provisional application No. 60/460,336, filed on Apr. 4, 2003.

(51) Int. Cl.
*G05F 1/00* (2006.01)
*H05B 41/36* (2006.01)

(52) U.S. Cl. ..... 315/194; 315/224; 315/220

(58) Field of Classification Search ..... 315/209 R, 315/219, 276, 291, 307, 224, 244, 308, 209 SC, 315/225, 247

See application file for complete search history.

(56) References Cited

U.S. PATENT DOCUMENTS

| | | | | |
|---|---|---|---|---|
| 3,681,654 | A * | 8/1972 | Quinn | 315/151 |
| 3,943,471 | A * | 3/1976 | Ryan | 334/59 |
| 4,187,450 | A | 2/1980 | Chen | 315/278 |
| 4,513,224 | A * | 4/1985 | Thomas | 315/141 |
| 4,700,111 | A * | 10/1987 | Folwell et al. | 315/200 R |
| 5,150,013 | A | 9/1992 | Bobel | |
| 5,615,093 | A | 3/1997 | Nalbant | |
| 6,087,781 | A * | 7/2000 | Leppelmeier | 315/200 A |
| 6,114,816 | A | 9/2000 | Nuckolls et al. | 315/324 |
| 6,320,773 | B1 * | 11/2001 | Urish et al. | 363/92 |
| 6,815,906 | B1 * | 11/2004 | Aarons et al. | 315/209 R |

FOREIGN PATENT DOCUMENTS

WO 03/019992 A1 3/2003

OTHER PUBLICATIONS

Wells, E., "Using the UC3871 and UC3872 Resonant Fluorescent Lamp Drivers in Floating Lamp Applications" Unitrode Design Note, DN-75, May 1997, pp. 1-4.

Lin, Mu-Shen et al., "Primary-Side Dimming Control Driver for Cold-Cathode Fluorescent Lamps", Electronic Letters, IEE Stevenage, GB., vol. 32, No. 15, Jul. 18, 1996, pp. 1334-1335.

Lin, Mu-Shen, et al., "A Cold-Cathode Fluorescent Lamp Driver Circuit with Synchronous Primary-Side Dimming Control" IEEE Transactions on Industrial Electronics, IEEE Inc, New York, US, vol. 45, No. 2, Apr. 1, 1998, pp. 249-255.

* cited by examiner

*Primary Examiner*—Don Wong
*Assistant Examiner*—Angela M Lie
(74) *Attorney, Agent, or Firm*—Roylance, Abrams, Berdo & Goodman, L.L.P.

(57) ABSTRACT

A high frequency sinusoidal wave is generated and applied directly to a gas discharge lamp in multiple phases in a power efficient electronic ballast. Uniting a high frequency current fed oscillator with a transformer, where direct current may be applied to the center tap of the transformer primary winding through an appropriately sized inductor to enable the impression of a sinusoidal alternating current at the secondary winding. This sinusoidal alternating current is applied directly to a gas discharge lamp. Feedback from the transformer controls the switching of the oscillator at resonant frequency.

10 Claims, 9 Drawing Sheets

3-PHASE WYE

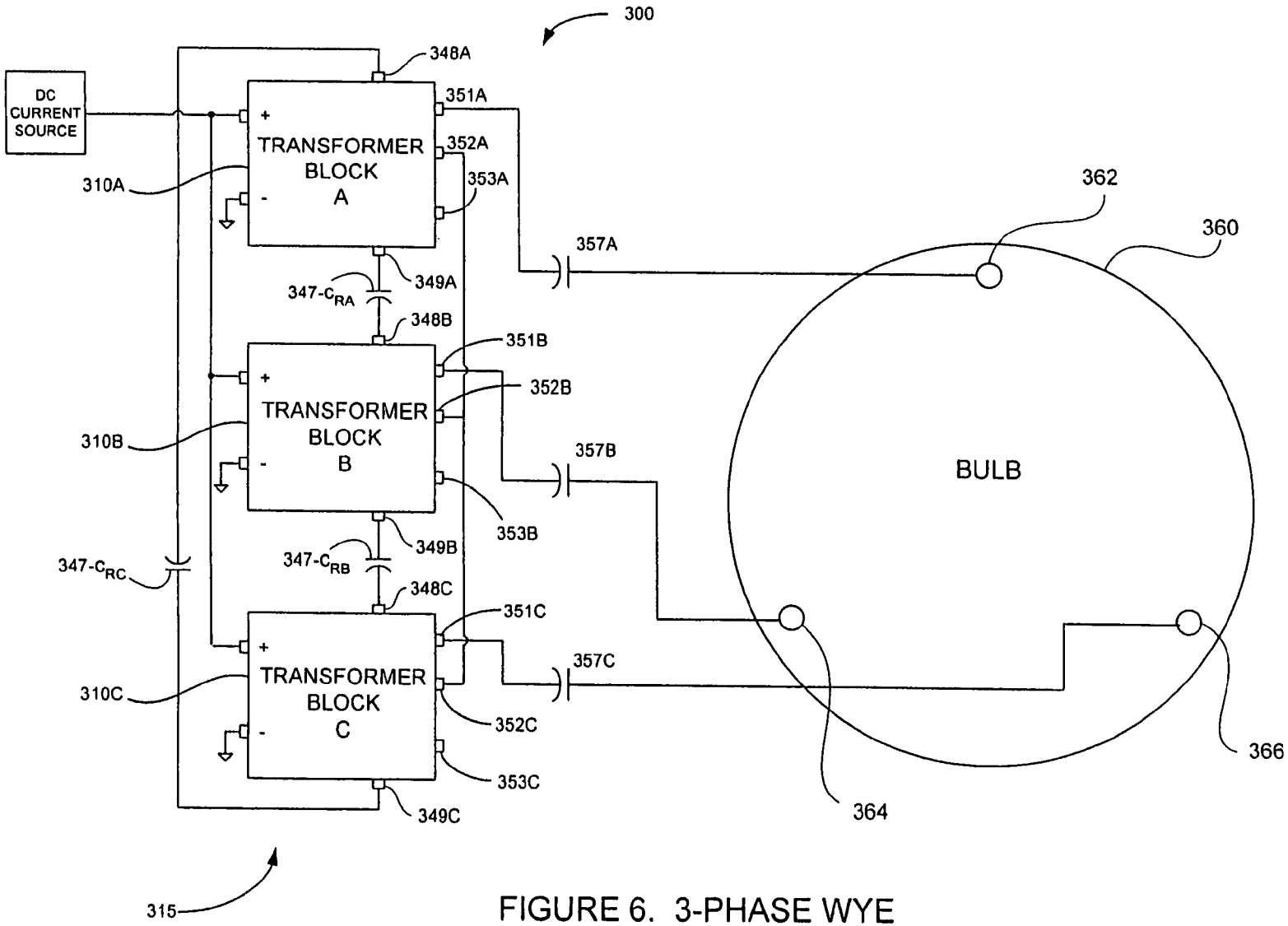
FIGURE 6. 3-PHASE WYE

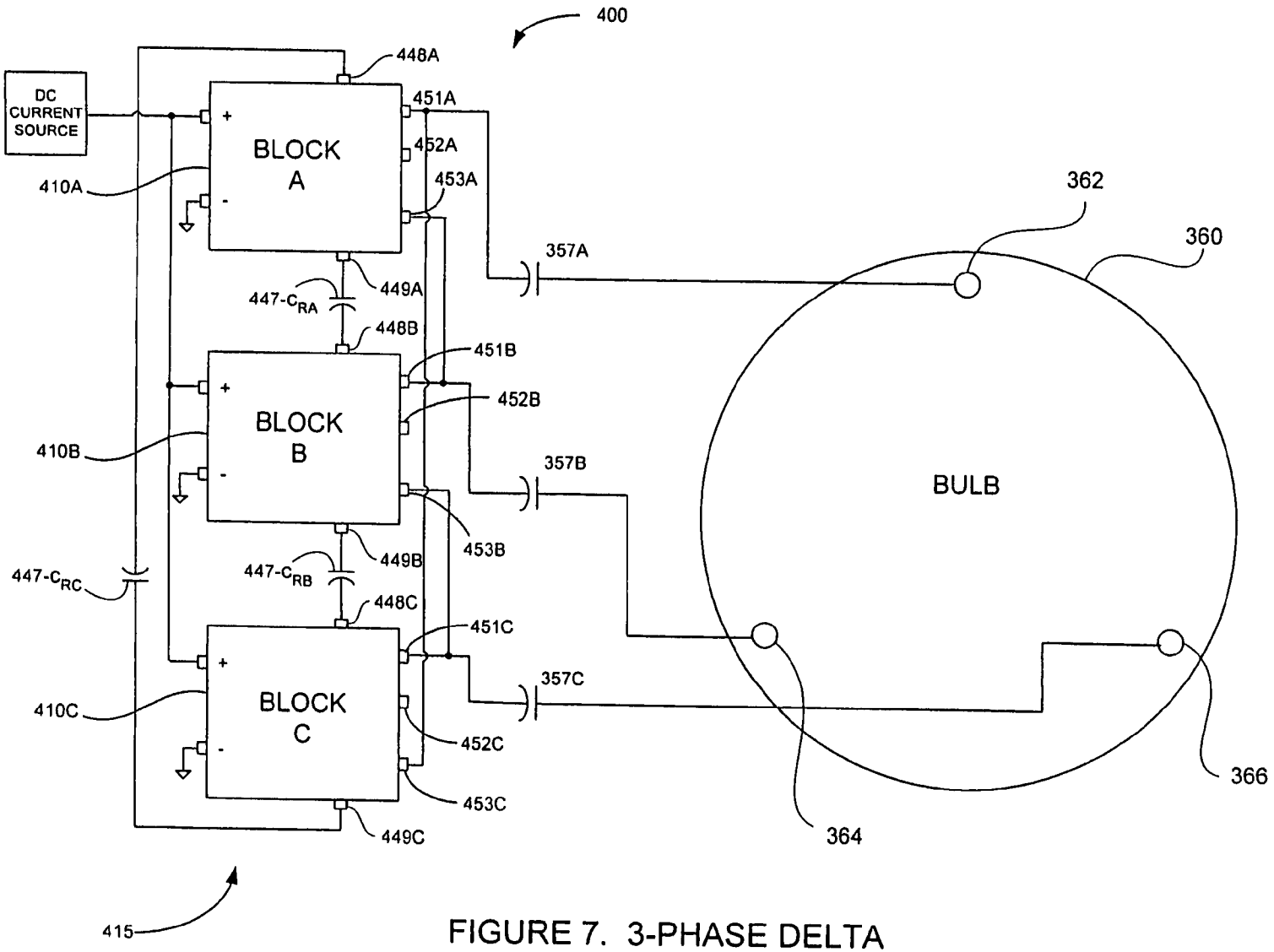
FIGURE 7. 3-PHASE DELTA

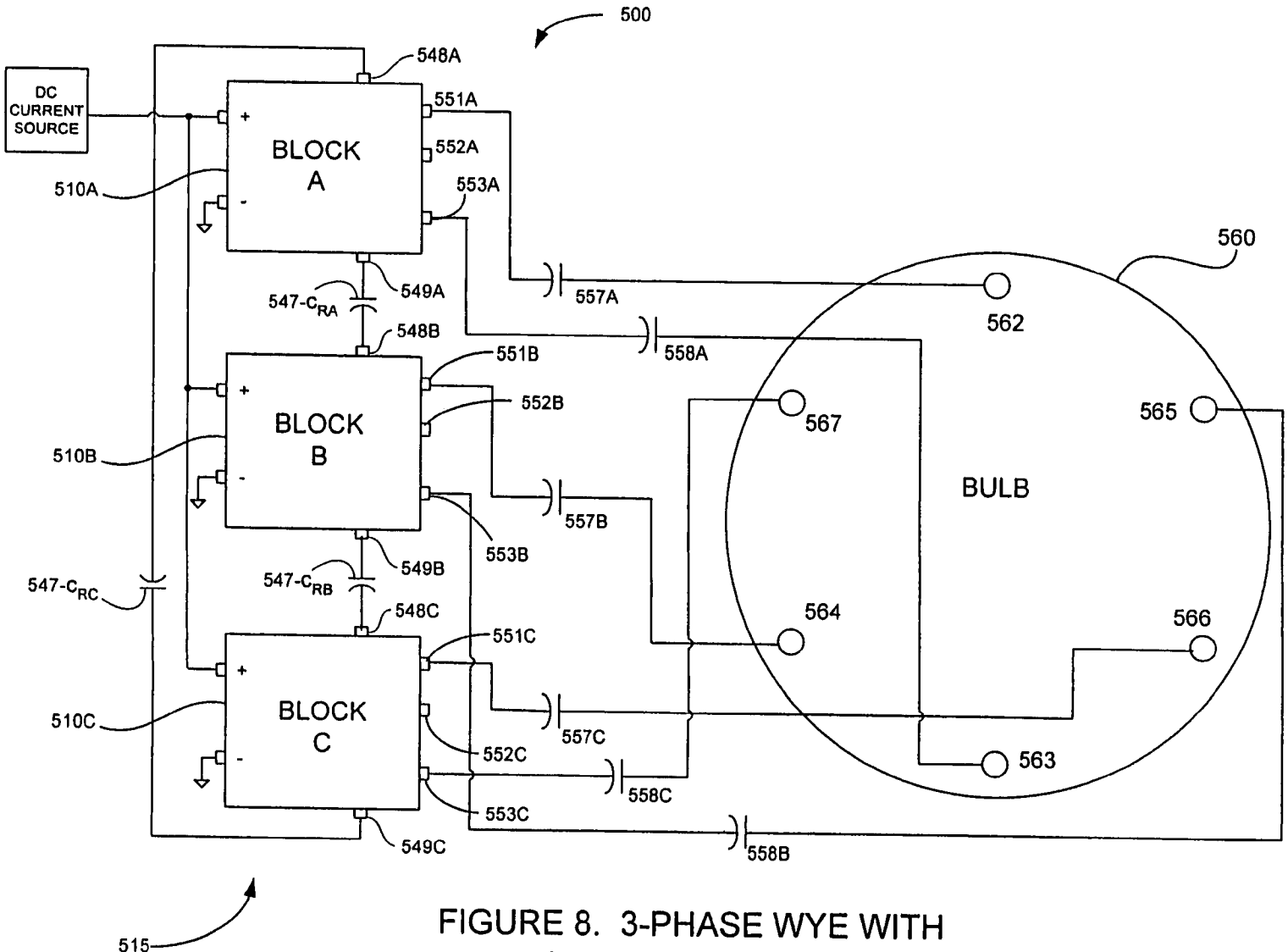
FIGURE 8. 3-PHASE WYE WITH 6 TERMINAL LAMP

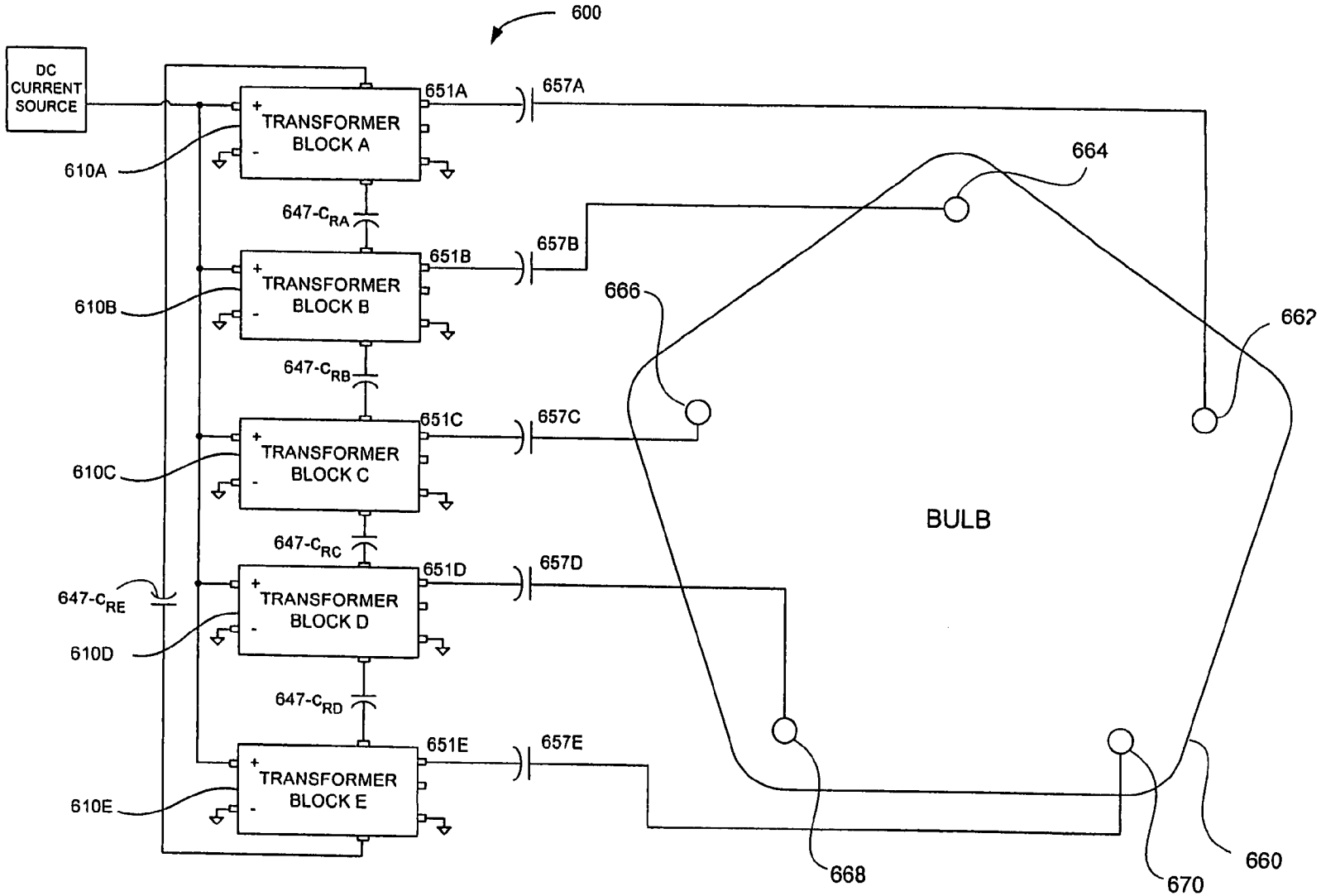
FIGURE 9. 5-PHASE WYE

HIGH FREQUENCY ELECTRONIC BALLAST WITH SINE WAVE OSCILLATOR

RELATED APPLICATIONS

This application claims priority under 35 U.S.C §119 to provisional patent application Ser. Nos. 60/460,381 and 60/460,336, both filed on Apr. 4, 2003, and both entitled "High Efficiency Electronic Ballast with Sine Wave Oscillator," both of which are incorporated by reference herein in their entirety.

BACKGROUND

The present invention relates generally to electronic ballasts for gas discharge lamps. More specifically, this invention relates to the production of a high efficiency electronic ballast by unifying power and lamp control at a high, resonant frequency of alternating current applied directly to fluorescent lamps.

Fluorescent light operates by creating a discharge or arc across an ionized gas within a glass tube. In traditional fluorescent lighting, the gas tube is filled with mercury vapor which, when ionized, can collide with electrons of a current flow across the electrodes of a lamp, and emit photons. These photons strike fluorescent material on the inner wall of the glass tube and produce visible light.

Fluorescent lamps require a ballast to operate. The ballast conditions the electric power to produce the input characteristics needed for the lamp. When arcing, the lamp exhibits a negative resistance characteristic, and therefore needs some control to avoid a cascading discharge. Both manufacturers and the American National Standards Institute specify lamp characteristics, which include current, voltage, and starting conditions. Historically, 50-60 Hz ballasts relied on a heavy core of magnetic material; today, most modern ballasts are electronic.

Electronic ballasts can include a starting circuit and may or may not require heating of the lamp electrodes for starting or igniting the lamp. Prior to ignition, a lamp acts as an open circuit; when an arc is created the lamp starts, the entire ballast starting voltage is applied to the lamp. After ignition, the current through the lamp increases until the lamp voltage reaches equilibrium based on the ballast circuit. Ballasts can also have additional circuitry designed to filter electromagnetic interference (EMI), correct power factor errors for alternating current power sources, filter noise, etc.

Electronic ballasts typically use a rectifier and an oscillating circuit to create a pulsed flow of electricity to the lamp. Common electronic lighting ballasts convert 60 Hz line or input current into a direct current, and then back to a square wave alternating current to operate lamps near frequencies of 20-40 kHz. Some lighting ballasts further convert the square wave to more of a sine wave, typically through an LC resonant lamp network to smooth out the pulses to create sinusoidal waveforms for the lamp. See, for example, U.S. Pat. No. 3,681,654 to Quinn, or U.S. Pat. No. 5,615,093 to Nalbant.

The square wave approach is common for a number of reasons. Many discrete or saturated switches are better suited to the production of a square wave than a sinusoidal wave. In lower frequency applications, a square wave provides more consistent lighting; a normal sinusoid at low frequency risks de-ionization of the gas as the voltage cycles below the discharge level. A square wave provides a number of other features, such as constant instantaneous lamp power, and favorable crest factors. With a square wave, current density in the lamp is generally stable, promoting long lamp life; similarly, there is little temperature fluctuation, which avoids flicker and discharge, damaging the lamp.

It is known that higher frequencies can produce more efficient lighting. In general, if de-ionization is minimized or avoided, then less energy is needed because there is no re-ionization of the gas; that is, a higher frequency avoids the cycle of decay and recovery of ionization within the lamp. Further, the anode fall voltage can be lower when the frequency is higher than the oscillation frequency of the plasma.

However, higher frequency ballasts suffer some problems. First, electronic ballasts can create harmonic disturbance, due in part to the use of pulses or square wave signals. Harmonics are signals in which the frequency is a whole number multiple of the system's fundamental frequency; the third harmonic is most damaging. The total harmonic distortion (or "THD") is one measure of ballast performance. Harmonics create unexpected or nonlinear loading of circuit elements; the harmonic signals cause voltage drops at points of impedance, at the frequency of the harmonic current. At high frequency, the circuitry required to convert a square wave into a sinusoidal wave may limit the available frequency of operation; high frequency voltage drops can change the voltage values of the fundamental wave. A ballast with a high THD may also create electromagnetic interference with nearby electrical equipment, necessitating additional circuitry to filter harmonics; however, such circuits can introduce additional problems such as high inrush current. Second, as discussed in U.S. Pat. No. 5,173,643 to Takehara, it is generally believed that operating frequencies above 50 KHz may introduce stray capacitance into lamp circuitry.

Finally, the semiconductor switches of many oscillating circuits in electronic ballasts have faced inefficiency or losses, including thermal dissipation, at high frequency driving. Thus, ballast technology has heretofore been limited, thereby also limiting the opportunity for improved energy efficiency.

SUMMARY

It should be emphasized that the terms "comprises" and "comprising", when used in this description and claims, are taken to specify the presence of stated features, steps, or components, but the use of these terms does not preclude the presence or addition of one or more other features, steps, components, or groups thereof.

In one aspect, a multi-phase electronic ballast for a gas discharge lamp includes a plurality of transformer blocks, one for each phase, each having a center tapped transformer and adapted to receive a current source and apply a sinusoidal alternating current to the gas discharge lamp having a corresponding phase different from the phase of other transformer blocks, the center tapped transformer including a feedback winding for controlling a fundamental frequency of the respective transformer block. For example, the transformer blocks can be in a three phase wye-connected configuration or in a three phase delta-connected configuration.

In another aspect, each transformer block includes a first circuit adapted to produce a sinusoidal alternating current at a voltage approximately equal to the strike voltage of said gas discharge lamp, the first circuit including an oscillator having a plurality of transistors and adapted to create the sinusoidal alternating current at the fundamental frequency of the first circuit, and a second circuit adapted to receive and apply the sinusoidal alternating current to the gas discharge lamp, the second circuit comprising a center tapped transformer having a feedback winding for controlling the transistors of the oscillator; at least one capacitor positioned in parallel to at least one of the windings of said transformer.

In another aspect, a method for driving a gas discharge lamp from a multi-phase electronic ballast includes oscillating a signal at a circuit's fundamental frequency using a pair of transistors to produce a first sinusoidal alternating current, and a voltage approximately equal to the strike voltage of said gas discharge lamp. At least one other signal is oscillated at a circuit's fundamental frequency using a pair of transistors to produce a second sinusoidal alternating current at a phase different from the phase of the first sinusoidal alternating current, and a voltage approximately equal to the strike voltage of the gas discharge lamp. The alternating currents are applied to the gas discharge lamp. For each alternating current, a signal proportional to the alternating current is fed back, the feedback signal being applied to each transistor of the oscillator to control the oscillated signal frequency. For each alternating current, a capacitor between the transistors of the oscillator charges and discharges with the feedback signal.

BRIEF DESCRIPTION OF THE DRAWINGS

Objects and advantages of the present invention will become apparent to those skilled in the art upon reading this description in conjunction with the accompanying drawings, in which like reference numerals have been used to designate like elements, and in which:

FIG. 6 is a schematic representation of a multi-phase lamp driver according to an embodiment of the invention.

FIG. 7 is a schematic representation of a multi-phase lamp driver according to an embodiment of the invention.

FIG. 8 is a schematic representation of a multi-phase lamp driver according to an embodiment of the invention.

FIG. 9 is a schematic representation of a multi-phase lamp driver according to an embodiment of the invention.

DETAILED DESCRIPTION

For the purposes of this specification and the appended claims, the terms "connected" or "joined" mean that there exists a conductive path, which may include elements that are not explicitly recited.

Figure 1:
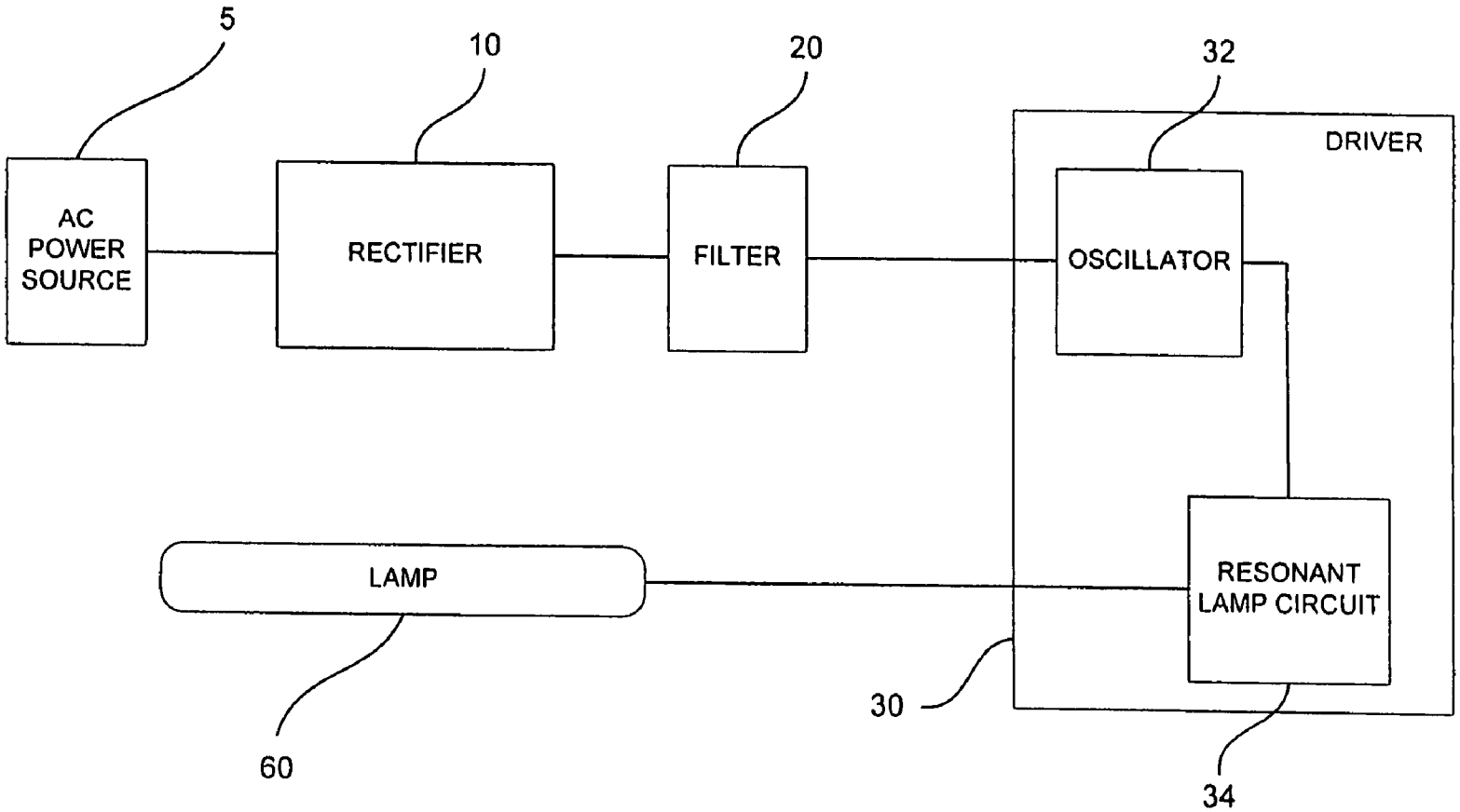
FIGURE 1 (PRIOR ART)
FIG. 1 is a block diagram of typical electronic ballast.

FIG. 1 shows a basic block diagram of the conventional approach to electronic ballast design; a rectifier 10 converts an alternating current from an AC power source 5 into direct current, which is passed through a filter 20 to a lamp driver 30 comprising an oscillator 32 and a resonant lamp circuit 34. The oscillator 32 generates a square wave at a frequency from 20 to 40 KHz. The lamp circuit 34 is required to condition the square wave for a lamp 60; this conditioning includes treatment of the wave as described above, such as filtering harmonic distortion and noise.

Figure 2:
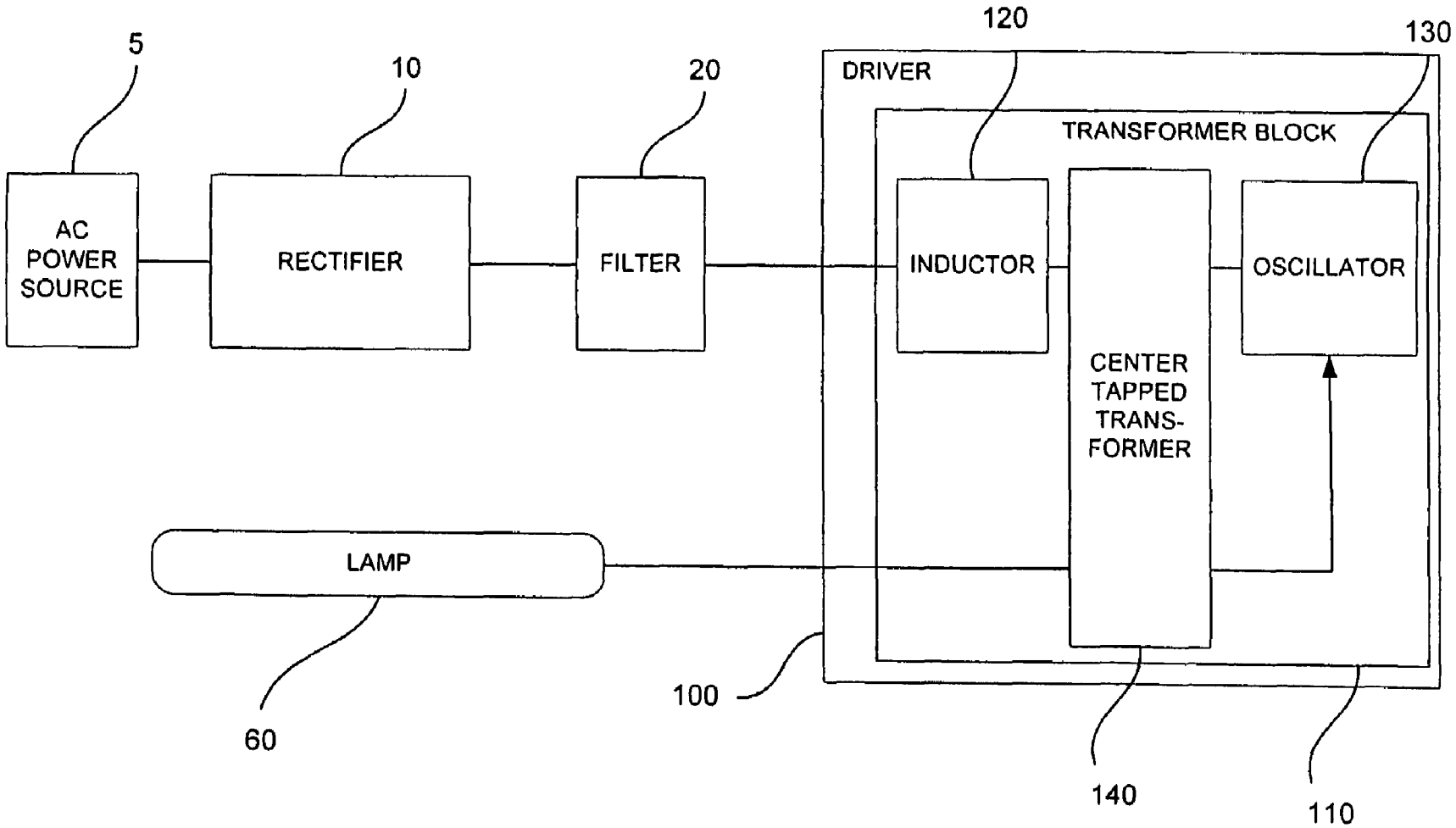
FIG. 2 is a block diagram of an embodiment of the invention adapted for receiving an alternating current input.

FIG. 2 is a basic block diagram of a lamp system incorporating an embodiment of the present invention adapted to receive an alternating current input. This design applies a fundamental, higher frequency, sinusoidal alternating current directly to the lamp 60 using a unified approach. As shown, a rectifier 10 converts the alternating current input from the AC power source 5 into a direct current, which may then be passed through filter to remove any alternating current ripple. The filter 20 may be any suitable L-C or Pi filter or the equivalent. It should be noted that the invention is not limited to alternating current sources of input power; the rectifier 10 and filter 20 may be omitted for applications involving a direct current input, as illustrated in FIG. 3.

The filtered current is then provided to a lamp driver 100, which comprises a current limiting inductance 120, a center tapped transformer 140, and an oscillator 130. The current limiting inductance 120 receives the filtered direct current and applies it to the center tapped transformer 140. The oscillator 130, in conjunction with the center tapped transformer 140, converts the filtered direct current into a high frequency alternating current across the primary of the transformer 140. Feedback from the transformer 140 is tuned by resonant capacitance, so that the oscillator 130 operates at the fundamental frequency of the circuit.

As will be discussed in more detail hereafter, driver embodiments according to the invention may comprise more than one transformer block providing current at a different phase.

Figure 3:
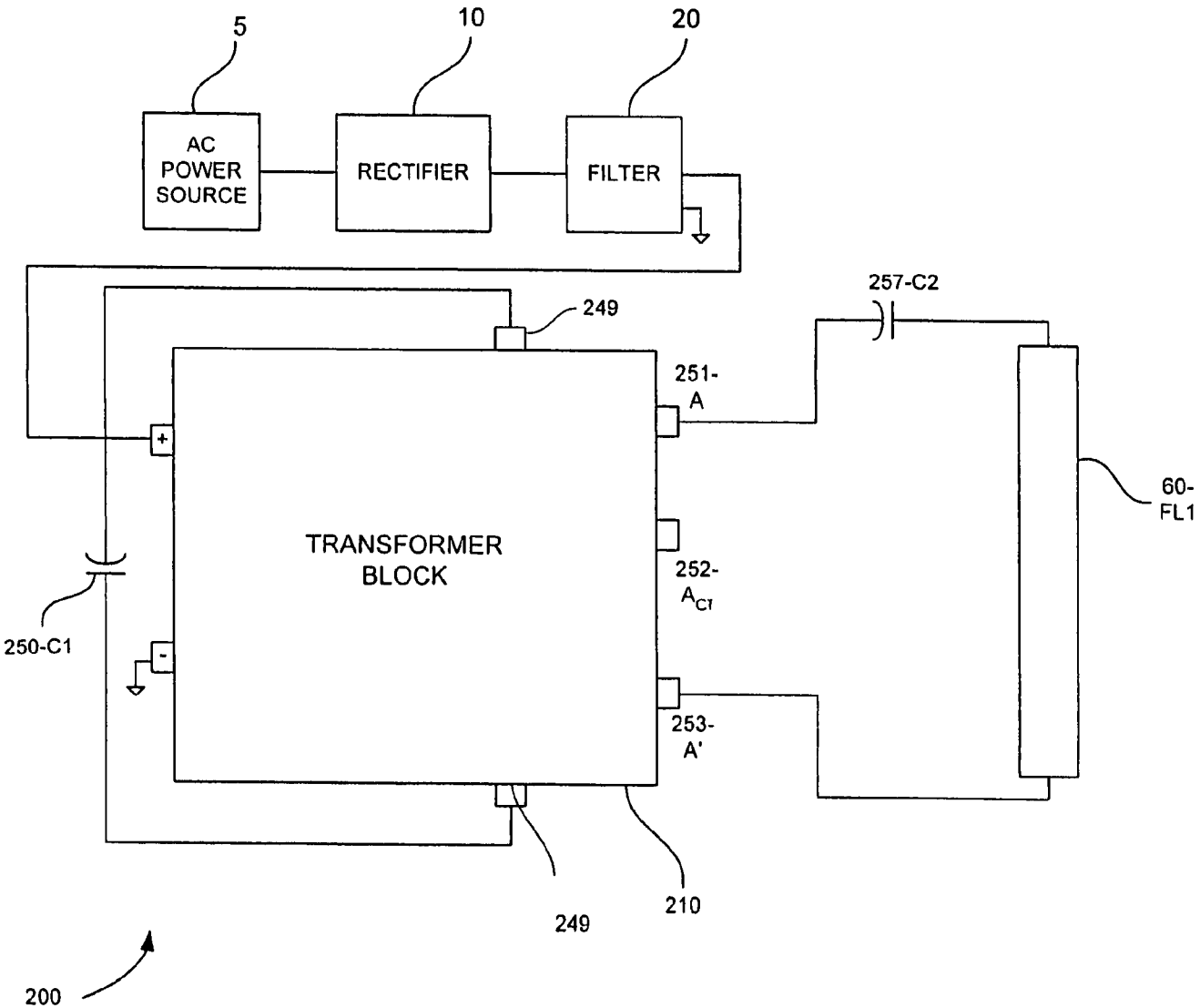
FIG. 3 is a block diagram of an embodiment of the invention adapted for receiving a direct current input.
Figure 4:
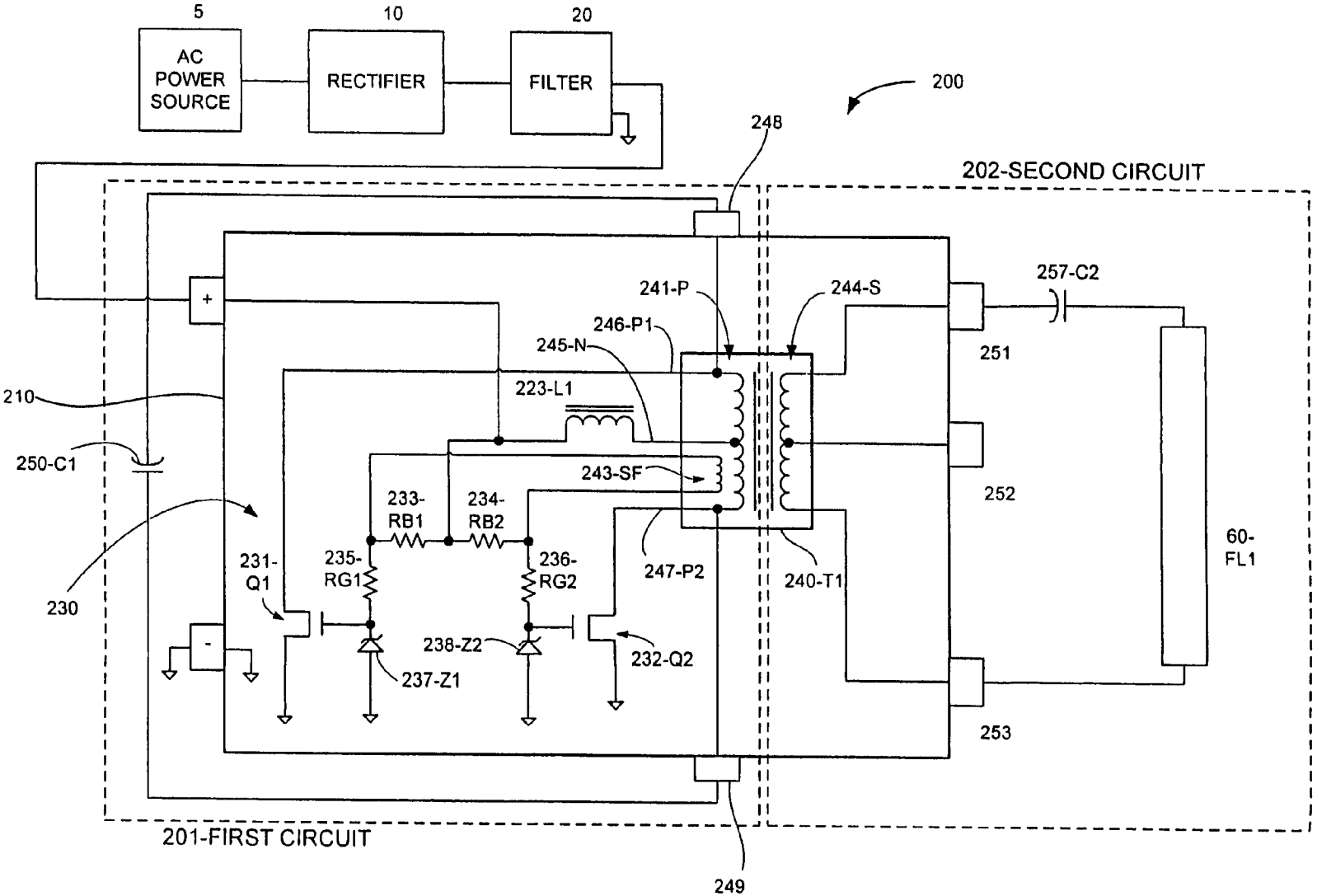
FIG. 4 is a schematic representation of a lamp driver according to an embodiment of the invention.

FIGS. 3 and 4 show a high frequency driver 200 according to an embodiment of the invention. As before, the alternating current power source 5 provides an alternating current that is converted to a direct current by rectifier 10, which may be one of any number of designs known in the art and capable of producing a direct current from an alternating current. A clean direct current that is free from any line or alternating current ripple is desired for embodiments with alternating current input in order to maintain the purity of the oscillator resonant frequency. Any ripple frequency energy could modulate the gas discharge lamp, and reduce efficiency. Accordingly, filter 20 is typically located after rectifier 10.

Figure 5:
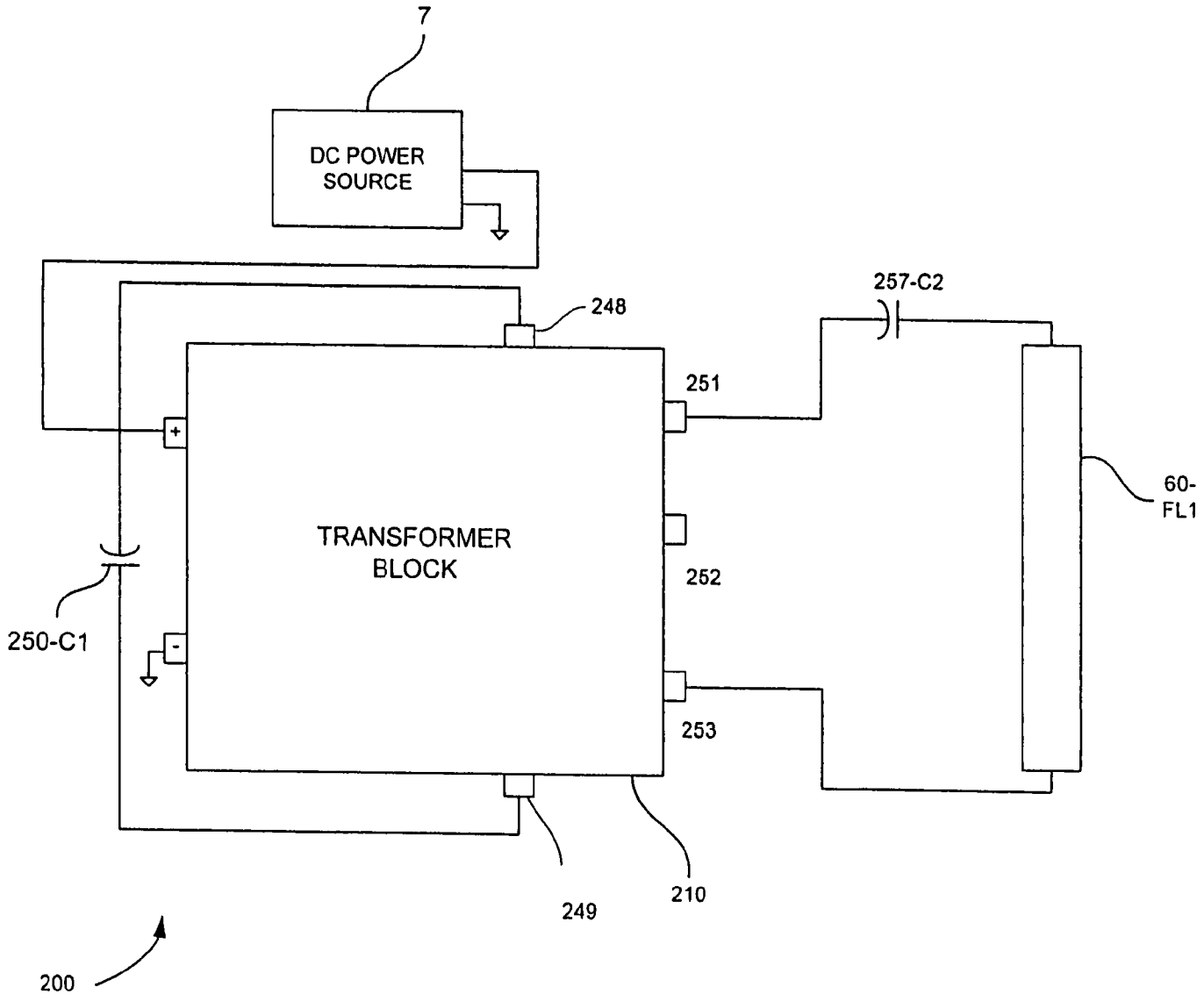
FIG. 5 is a schematic representation of a lamp driver according to an embodiment of the invention.

Filter 20 can employ any of a variety of filter designs well known in the art and is therefore not shown in detail. In addition, those skilled in the art will recognize that with a direct current power supply or input, rectifier 10 and filter 20 may be omitted, as shown in FIG. 5, or replaced with a single diode or other such components appropriate for that direct current input.

The high frequency driver 200 comprises a transformer block 210 and a resonance capacitor 250-CI. A transformer block 210 includes a center tapped transformer 240-T1, a current limiting inductor or choke 223-L1, and an oscillator portion 230. Inductor 223-L1 receives the filtered direct current, and acts to limit current change. As discussed below, inductor 223-L1 plays a role in setting the voltage ultimately applied to lamp 60. The output of inductor 223-L1 is applied to center tap 245-N of primary winding 241-P of transformer 240-T1; that is, center tap 245-N splits the primary winding 241-P of transformer 240-T1 into a first portion 246-P1 and a second portion 247-P2.

The first and second primary portions 246-P1 and 247-P2 are connected to the oscillator 230. The oscillator 230 includes first and second transistors 231-Q1 and 232-Q2, which are joined drain-to-drain, with the junction occurring across primary winding 241-P of transformer 240-T1. That is, each end of primary winding 241-P connects to a drain of one of transistors 231-Q1 and 232-Q2. Although field effect transistors (FET) are shown, transistors 231-Q1 and 232-02 may alternatively be bipolar or other equivalents. Resistors 235 and 236 serve to limit the current into the gates of transistors 231 and 232 and into Zener diodes 237 and 238. Zener diodes 237 and 238 serve to limit the voltage that is impressed on the gates of 231 and 232. Resistors 233 and 234 provide bias for starting. Zener diodes 237 and 238 also serve to prevent excessive negative voltage on the gates of transistors 231 and 232.

The primary winding 241-P of the transformer 240-T1, the inductor 223-L1 and the oscillator 230 combine to form a first circuit 201. Secondary winding 244-S, which is coupled to primary winding 241-P, is positioned in series with the gas discharge lamp 60-FL1, which is connected to first and second output ports 251, 253. In some embodiments, it may be desirable to drive the lamp 60 using only one side of the secondary winding 244-S. In such instances, the lamp 60 may be connected to the center tap output 252 and either of the first and second output ports 251, 253. It is desirable to introduce some capacitance in series with lamp 60-FL1 and secondary winding 244-S in order to offer some ballast and provide direct current blocking for lamp 60-FL1. This capacitance is represented by capacitor 257-C2, but could also include alternate configurations of circuit design available to create a capacitance in the absence of a discrete, separate component, as is known in the art. By way of example and not limitation, such configurations may include alternatives such as placing two conductors near each other without touching.

Thus, capacitor 257-C2 is in series with secondary winding 244-S and lamp 60-FL1, thereby forming a second circuit 202. This design may include other circuitry as desired for the particular application; for example, the system may include one or more heaters, which are generally omitted for use with cold cathode fluorescent lamps.

The no load voltage impressed on the secondary winding 244-S of transformer 240-T1 is preferably approximately equal to the strike voltage of lamp 60-FL1. The alternating current output voltage of oscillator 230 at transformer 240-T1 is a linear function of the voltage at inductor 223-L1. Those skilled in the art will readily see how components of a variety of values could achieve this objective.

The transformer block 210 may also include a feedback winding 243-SF that may be coupled either to primary winding 241-P or secondary winding 244-S. Those skilled in the art will recognize that this feedback may be provided in a variety of ways to achieve a similar effect, possibly even arranged by a separate transformer. In the illustrated embodiment, the gates of transistors 231-Q1 and 232-Q2 are joined across feedback winding 243-SF, with the resonance capacitor 250-CI in parallel with the feedback winding 243-SF. The resonance capacitor 250-CI may be connected to the transformer block at a first connection point 248 connected to the first primary portion 246-P1 and a second connection point 249 connected to the second primary portion 247-P2. The resonance capacitor 250-CI may alternatively be located in parallel with primary winding 241-P, secondary winding 244-S, or a combination thereof.

Resistors 235 and 236 serve to limit the current into the gates of transistors 231 and 232 and into zener diodes 237 and 238. Zener diodes 237 and 238 serve to limit the voltage that is impressed on the gates of 231 and 232. Resistors 233 and 234 provide bias for starting. Zener Diodes 237 and 238 also serve to prevent excessive negative voltage on the gates of transistors 231 and 232.

It will be understood by those of ordinary skill in the art that the lamp 60-FL1 may be a single gas discharge lamp or may be a plurality of gas discharge lamps, with such minor adaptations to second circuit 2 as are known in the art. Although the present invention is operable with lamps of a variety of sizes, the use of physically smaller lamps, e.g., T1 through T3 (those of a diameter of ⅛ to ⅜ inches), demonstrated better lighting performance. The use of tri- or quad-phosphor lamps will further increase light output bandwidth within the visible frequency spectrum.

In some embodiments, a power conversion stage may be included with a basic power factor correction circuit in order to regulate lamp power from line voltage changes.

In operation, the electronic ballast described above is designed to produce a more efficient conversion of input energy into light than has been achieved in conventional ballasts. By applying a sinusoidal alternating current to the lamp at high frequency, preferably above 100 KHz, the ballast prevents de-ionization and improves efficiency. A unified approach to the generation and application of a sinusoidal wave eliminates the two step creation of a discrete square wave that must then treated by an L-C or other circuit to render it more sinusoidal. Such a two step approach is vulnerable to harmonic distortion, electromagnetic interference, and noise. The generation of a pure sine wave is better suited for gas discharge lamps and is significantly less vulnerable to harmonic distortion, electromagnetic interference, and noise. Although the present invention is operable with lamps of a variety of sizes, the use of physically smaller lamps, e.g., T1 through T3 (those of a diameter of ⅛ to ⅜ inches), demonstrated better lighting performance than in larger lamps. The use of tri- or quad-phosphor lamps will further increase light output bandwidth within the visible frequency spectrum.

With reference again to FIG. 4, a current-fed oscillator may be employed to convert a direct current into a sinusoidal alternating current for driving a lamp. A direct current is applied to inductor 223-L1. The oscillation is formed when transistors 231-Q1 and 232-Q2 alternatively switch, conducting against the impedance of inductor 223-L1, into center tap 245-N, and across the respective portions of primary winding 241-P to form a sinusoidal alternating current. The voltage of the alternating current is a linear function of the voltage at inductor 223-L1, determining the wave amplitude. A base signal for transistors 231-Q1 and 232-Q2 is provided by feedback winding 243-SF, which is timed by parallel capacitor 250-C1. Selection of the values of the individual components of the unified electronic ballast should preferably produce a no load voltage for the alternating current equal to the strike voltage of lamp 60-FL1. An induced sinusoidal alternating current is produced in secondary winding 244-S by its coupling with primary 241-P. The current at lamp 60-FL1 is ballasted by a small capacitance, as provided, for example, by a high-voltage capacitor 257-C2 positioned in series with lamp 60-FL1. Capacitor 257-C2 may also perform direct current blocking to resist lamp mercury migration.

In general, the operating frequency of an oscillator is determined by the resonant frequency of the tank circuit formed by the capacitive and inductive components, and the load that is coupled across the output, such as transformer 240-T1. In this case the oscillation occurs at the loaded resonant frequency of the network formed by capacitor 250-C1, the magnetizing inductance of primary winding 241-P, and the reflected impedance of the output load at secondary winding 244-S (lamp, capacitor 257-C2, and any stray capacitance). Capacitor 250-C1 may be placed across, (i.e., in parallel with) any winding or combination of windings of transformer 240-T1 to achieve the desired effect. Preferably this oscillator operates at a frequency above 100 KHz.

The sinusoidal shape of the alternating current is dependent upon the quality factor or "Q value" of the loaded circuit. The loaded Q value is preferably greater than 3 to ensure stable operation; a value between 6 and 12 may be typical. Another aspect of the relatively high Q factor is that a large amount of energy circulates within the circuit relative to the amount of power delivered to the gas discharge lamp. In a less efficient design at high frequency, this characteristic could cause stray capacitance, losses, noise, and interference, particularly if the lamp requires greater energy. In the preferred embodiment, a relatively high current circulates on the side of primary winding 241-P of transformer 240-T1 at a relatively low voltage, and a lower current circulates on the side of secondary winding 244-S of transformer 240-T1, at a relatively higher voltage. Inasmuch as it is an object of the present invention to reduce power consumption for lighting, the topologies described are well suited to operation at lower power levels. For example, the present invention has shown the ability to provide 100 Watts of effective lighting for 15 Watts of power in a hot cathode lamp and 7.5 Watts of power in a cold cathode lamp.

It will be understood that for any sine wave oscillator driven lamp system, the maximum light output for a given frequency would be obtained from a pure sine wave with no harmonic content. As noted above, one problem with previous attempts at using sine wave oscillators in gas discharge lamp drivers has been the loss in efficiency due to the presence of harmonic content. The lamp driver 200 provides a significant advantage over previous drivers in that the oscillator 230 and the inductor 223-L1 may be specifically adapted to filter the third harmonic. Because the majority of the harmonic content is in the third harmonic, elimination of the third harmonic provides a sine wave that produces a light output that approaches that for an ideal oscillator.

The particular inductance value for the inductor 223-L1 is dependent on the specific design parameters of and components used in the driver 200. It will be understood, however, that the typical inductance value will be greater than 1 mH and will be selected to filter out the third harmonic. This differs significantly from prior art oscillators such as, for example, a Royer oscillator, which in a similar application would use an inductor solely for the purpose of preventing excessive cross currents. Such inductors typically have an inductance value of a few mH.

As was noted above, a lamp driver according to the present invention may also be used to provide a multi-phase output. In the embodiment illustrated in FIG. 6, a multi-phase lamp driver 300 includes three transformer blocks 310A, 310B, 310C, which may be incorporated into a single transformer. Internally, each transformer block 310A, 310B, 310C is wired in a manner that is substantially similar to the transformer block 210 of the lamp driver 200 shown in FIGS. 3 and 4. As shown in FIG. 6, however, the transformer blocks 310A, 310B, 310C are interconnected so that the current output of each transformer block is 120 degrees out of phase with the other two transformer blocks. Transformer block 310A has first and second output ports 351A, 353A and a center tap output port 352A. Transformer block 310B has first and second output ports 351B, 353B and a center tap output port 352B. Transformer block 310C has first and second output ports 351C, 353C and a center tap output port 352C.

In the embodiment shown in FIG. 6, the transformer blocks 310A, 310B, 310C are interconnected by three resonance capacitors 347-$C_{RA}$, 347-$C_{RB}$, 347-$C_{RC}$ to form a three-phase wye-connected transformer 315. A first resonance capacitor 347-$C_{RA}$ connects transformer block A connection point 349A to transformer B connection point 348B. A second resonance capacitor 347-$C_{RB}$ connects transformer block B connection point 349B to transformer C connection point 348C. A third resonance capacitor 347-CRC connects transformer block C connection point 349C to transformer A connection point 348A. As shown in FIG. 6, the transformer blocks 310A, 31013, 310C are also connected across their output center taps 352A, 352B, 352C.

The three phase wye-connected transformer 315 may be connected to any load requiring three-phase input but is particularly suited to connection to gas discharge lamp bulb 360. As shown, the first output port 351A of transformer block A is connected through a series capacitor 357A to a first electrode 362 of the bulb 360, the first output port 351B of transformer block B is connected through a series capacitor 357B to a second electrode 364 and the first output port 351C of transformer block C is connected through a series capacitor 357C to a third electrode 366. The gas discharge bulb 360 may be a thin-walled glass vessel defining an interior space containing a gas adapted for plasma generation. The three electrodes 362, 364, 366 are configured to extend into the bulb interior so that when current is passed through the electrodes plasma paths are formed therebetween. The driver 300 provides a sinusoidal current input to each electrode that is 120 degrees out of phase with the sinusoidal input to each other electrode. This significantly reduces the de-energizing of the plasma and maintains a higher overall lamp brightness for a given input frequency and energy input.

As shown in FIG. 6, the lamp bulb 360 is a substantially planar disc. It may, however, be virtually any geometric shape including planar structures having any 2-dimensional plan-form and 3-dimensional structures such as spheres, prisms cylinders and the like.

In another embodiment, illustrated in FIG. 7, a multi-phase lamp driver 400 includes three transformer blocks 410A, 410B, 410C, which may be incorporated into a single transformer. Internally, each transformer block 410A, 410B, 410C is wired in a manner that is substantially similar to the transformer block 210 of the lamp driver 200 shown in FIGS. 3 and 4. As in the previous embodiment, however, the transformer blocks 410A, 410B, 410C are interconnected so that the current output of each transformer block is 120 degrees out of phase with the other two transformer blocks. Transformer block 410A has first and second output ports 451A, 453A and a center tap output port 452A. Transformer block 410B has first and second output ports 451B, 453B and a center tap output port 452B. Transformer block 410C has first and second output ports 451C, 453C and a center tap output port 452C.

In the embodiment shown in FIG. 7, the transformer blocks 410A, 410B, 410C are interconnected by three resonance capacitors 447-CRA, 447-CRB, 447-CRC to form a three-phase delta-connected transformer 415. A first resonance capacitor 447-CRA connects transformer block A connection point 449A to transformer B connection point 448B. A second resonance capacitor 447-CRB connects transformer block B connection point 449B to transformer C connection point 448C. A third resonance capacitor 447-CRC connects transformer block C connection point 449C to transformer A connection point 448A. As shown in FIG. 7, the transformer blocks 410A, 410B, 410C are also connected across their second output ports 453A, 453B, 453C to produce the delta configuration.

The three phase delta-connected transformer 415 may be connected to any load requiring three-phase input but is particularly suited to connection to gas discharge lamp bulb 360, which is identical to the lamp bulb shown in FIG. 6. As shown, the first output port 451A of transformer block A is connected through a series capacitor 357A to a first electrode 362 of the bulb 360, the first output port 451B of transformer block B is connected through a series capacitor 357B to a second electrode 364 and the first output port 451C of transformer block C is connected through a series capacitor 357C to a third electrode 366. The driver 400 provides a sinusoidal current input to each electrode that is 120 degrees out of phase with the sinusoidal input to each other electrode. This significantly reduces the de-energizing of the plasma and maintains a higher overall lamp brightness for a given input frequency and input power.

In the embodiment illustrated in FIG. 8, a multi-phase lamp driver 500 includes three transformer blocks 510A, 510B, 510C, which may be incorporated into a single multiphase transformer, using a common core with multiple legs. Internally, each transformer block 510A, 510B, 510C is wired in a manner that is substantially similar to the transformer block 210 of the lamp driver 200 shown in FIGS. 3 and 4. As shown in FIG. 8, however, the transformer blocks 510A, 510B, 510C are interconnected so that the current output of each transformer block is 120 degrees out of phase with the other two transformer blocks. Transformer block 510A has first and second output ports 551A, 553A and a center tap output port 552A. Transformer block 510B has first and second output ports 551B, 553B and a center tap output port 552B. Transformer block 510C has first and second output ports 551C, 553C and a center tap output port 552C.

In the embodiment shown in FIG. 8, the transformer blocks 510A, 510B, 510C are interconnected by three resonance capacitors 547-$C_{RA}$, 547-$C_{RB}$, 547-$C_{RC}$ to form a three-phase wye-connected transformer 515 similar to that of the lamp driver 300 in FIG. 6. A first resonance capacitor 547-$C_{RA}$ connects transformer block A connection point 549A to transformer B connection point 548B. A second resonance capacitor 547-$C_{RB}$ connects transformer block B connection point 549B to transformer C connection point 548C. A third resonance capacitor 547-$C_{RC}$ connects transformer block C connection point 549C to transformer A connection point 548A. In this embodiment, however, the transformer blocks 510A, 510B, 510C are not connected across their output center taps 552A, 552B, 552C.

In this embodiment, both sides of the secondary transformers in the transformer blocks 510A, 510B, 510C are used. The first side is used to power three of the electrodes 562, 564, 566 and the second side is used to power another three electrodes 563, 565, 567. Thus, the first output port 551A of transformer block A is connected through a series capacitor 557A to a first electrode 562 of the bulb 560, the first output port 551B of transformer block B is connected through a series capacitor 557B to a second electrode 564 and the first output port 551C of transformer block C is connected through a series capacitor 557C to a third electrode 566. Further, the second output port 553A of transformer block A is connected through a series capacitor 558A to a fourth electrode 563 of the bulb 560, the second output port 553B of transformer block B is connected through a series capacitor 558B to a fifth electrode 565 and the second output port 553C of transformer block C is connected through a series capacitor 558C to a sixth electrode 567.

The gas discharge bulb 560 is similar to those described above except that it is provided with the six electrodes 562, 563, 564, 565, 566, 567. The driver 500 provides a sinusoidal current input to each of the first, second and third electrodes 562, 564, 566 that are 120 degrees out of phase with the sinusoidal input to each other of these three electrodes. The driver 500 also provides a sinusoidal current input to each of the fourth, fifth, and sixth electrodes 563, 565, 567 that is 120 degrees out of phase with the sinusoidal input to each other of these three electrodes.

Any of the above-described embodiments may be expanded to include any number of transformer blocks and any number of output current phases. FIG. 9 for example shows a five phase lamp driver 600 configured to provide five phase output to a lamp bulb 660 having five electrodes 662, 664, 666, 668, 670. The lamp driver 600 has five transformer blocks 610A, 610B, 610C, 610D, 610E interconnected to form a five phase wye-connected transformer 615. The wiring of the transformer 615 is similar to that of transformer 315 of FIG. 5 with transformer blocks A, B, C, D and E connected through resonance capacitors 647-$C_{RA}$, 647-$C_{RB}$, 647-$C_{RC}$, 647-$C_{RD}$, 647-$C_{RE}$.

Transformer block output ports 651A, 651B, 651C, 651D, 651E are respectively connected to lamp bulb electrodes 662, 664, 666, 668, 670 through series capacitors 657A, 657B, 657C, 657D, 657E. As in previous embodiments, the gas discharge lamp bulb 660 may be a thin-walled glass vessel defining an interior space containing a gas adapted for plasma generation. The actual wall thickness may vary depending upon the size of the bulb. The five electrodes 662, 664, 666, 668, 670 are configured to extend into the bulb interior so that when current is passed through the electrodes plasma paths are formed therebetween. The driver 600 provides sinusoidal current inputs to the electrodes with regularly spaced phase shifts. Thus the five electrodes are energized by sine waves that are spaced by 360/5 or 72 degrees.

The present invention may be used to provide an N-phase output to a gas discharge bulb having N electrodes where N is any integer. The phase shift between electrodes is preferably 360/N. It will be understood by those of ordinary skill in the art that for a given bulb volume and oscillation frequency, the higher the number of phases/electrodes, the greater the efficiency of the lamp/driver system. It will also be understood by those of ordinary skill in the art that, at some point, the cost of increasing the number of phases will outweigh the benefit of the improvement in performance.

As before, the lamp bulb 660 may be any shape. FIG. 9 illustrates how the number and pattern of electrodes may be tailored to the geometric shape of the bulb. It will be understood, however, that although symmetry of the electrodes may be advantageous in some circumstances, it is not required in order to take advantage of the high frequency multi-phase input provided by the lamp drivers of the present invention.

It will be appreciated by those of ordinary skill in the art that the invention can be embodied in various specific forms without departing from its essential characteristics. The disclosed embodiments are considered in all respects to be illustrative and not restrictive. The scope of the invention is indicated by the appended claims, rather than the foregoing description, and all changes that come within the meaning and range of equivalents thereof are intended to be embraced thereby.

What is claimed is:

1. A multi-phase electronic ballast for a gas discharge lamp, comprising at least three transformer blocks, one for each phase, each having a center tapped transformer and adapted to receive a current source and apply a sinusoidal alternating current to the gas discharge lamp having a corresponding phase different from the phase of other transformer blocks, the center tapped transformer including a feedback winding for controlling a fundamental frequency of the respective transformer block, wherein the electronic ballast includes transformer blocks in a three phase wye-connected configuration.

2. A multi-phase electronic ballast for a gas discharge lamp, comprising at least three transformer blocks, one for each phase, each having a center tapped transformer and adapted to receive a current source and apply a sinusoidal alternating current to the gas discharge lamp having a corresponding phase different from the phase of other transformer blocks, the center tapped transformer including a feedback winding for controlling a fundamental frequency of the respective transformer block, wherein the electronic ballast includes transformer blocks in a three phase delta-connected configuration.

3. A multi-phase electronic ballast for a gas discharge lamp, comprising at least three transformer blocks, one for each phase, each having a center tapped transformer and adapted to receive a current source and apply a sinusoidal alternating current to the gas discharge lamp having a corresponding phase different from the phase of other transformer blocks, the center tapped transformer including a feedback winding for controlling a fundamental frequency of the respective transformer block, wherein each transformer block is connected to a corresponding electrode of the gas discharge lamp through a respective series capacitor.

4. A multi-phase electronic ballast for a gas discharge lamp, comprising at least three transformer blocks, one for each phase, each having a center tapped transformer and adapted to receive a current source and apply a sinusoidal alternating current to the gas discharge lamp having a corresponding phase different from the phase of other transformer blocks, the center tapped transformer including a feedback winding for controlling a fundamental frequency of the respective transformer block, wherein each transformer block comprises:

a first circuit adapted to produce a sinusoidal alternating current at a voltage approximately equal to the strike voltage of said gas discharge lamp, the first circuit including an oscillator having a plurality of transistors and adapted to create the sinusoidal alternating current at the fundamental frequency of the first circuit;

a second circuit adapted to receive and apply the sinusoidal alternating current to the gas discharge lamp, the second circuit comprising a center tapped transformer having a feedback winding for controlling the transistors of the oscillator; and at least one capacitor positioned in parallel to at least one of the windings of said transformer.

5. The multi-phase electronic ballast of claim 4, wherein the first circuit is adapted to produce a sinusoidal alternating current at a frequency of over 100 KHz.

6. The multi-phase electronic ballast of claim 4, comprising a rectifier adapted to convert alternating current into a direct current and a filter adapted to remove any alternating current ripple from the direct current.

7. The multi-phase electronic ballast of claim 4, wherein the oscillator further comprises a current limiting inductor.

8. The multi-phase electronic ballast of claim 4, wherein the center tapped transformer is configured such that:

an output of said inductor is applied to a center tap of a primary winding of said transformer;

outputs of the oscillator transistors are joined at the ends of said primary winding of said transformer;

a secondary winding of said transformer is coupled to said primary winding, wherein said secondary winding is in series with said gas discharge lamp; and a means for introducing a capacitance in series with the secondary of said transformer.

9. The multi-phase electronic ballast of claim 8, wherein the means for introducing a capacitance is a capacitor connected in series with the secondary of said transformer.

10. The multi-phase electronic ballast of claim 4, wherein the first circuit is adapted to receive a direct current.

* * * * *